US006789847B1

(12) United States Patent
Tsai

(10) Patent No.: US 6,789,847 B1
(45) Date of Patent: Sep. 14, 2004

(54) RECLINING CHAIR

(76) Inventor: Sung-Tsun Tsai, 58, Ma Yuan West St., Taichung (TW)

( * ) Notice: Subject to any disclaimer, the term of this patent is extended or adjusted under 35 U.S.C. 154(b) by 0 days.

(21) Appl. No.: 10/615,482

(22) Filed: Jun. 25, 2003

(51) Int. Cl.[7] ..... A47C 1/032

(52) U.S. Cl. ..... 297/342; 297/321; 297/322; 74/501.6; 74/502.6

(58) Field of Search ..... 297/317, 320, 297/321, 322, 342; 74/501.6, 502, 502.6

(56) References Cited

U.S. PATENT DOCUMENTS 2,522,246 A * 9/1950 Armstrong ..... 297/322
4,877,291 A * 10/1989 Taylor ..... 297/322
5,082,324 A * 1/1992 Harada et al. ..... 297/83
5,209,549 A * 5/1993 Chang ..... 297/320
5,497,676 A * 3/1996 Barnard ..... 74/501.5 R
6,253,881 B1 * 7/2001 Andersson ..... 188/67
6,308,804 B1 * 10/2001 Roberts ..... 74/501.6
6,575,531 B1 * 6/2003 Tseng ..... 297/320

* cited by examiner

*Primary Examiner*—Peter R. Brown

(57) ABSTRACT

A reclining chair has a control switch and a control device. The control device has a tube connected to a support frame, a joint disposed on a seat, a rod inserted through the tube and connected to the joint, a control thread connected to the control switch and a cylindrical block, an inner threaded socket disposed on the tube, a hollow cylinder disposed on a positioning mount, a compression spring inserted in the hollow cylinder, a positioning pin passing through the compression spring and the hollow cylinder, the hollow cylinder engaging with the inner threaded socket, a connector clamping a tail of the positioning pin, the control thread passing through an angle plate of the positioning mount, and the cylindrical block inserted in the connector.

4 Claims, 6 Drawing Sheets

FIG. 3

RECLINING CHAIR

BACKGROUND OF THE INVENTION

The present invention relates to a reclining chair. More particularly, the present invention relates to a control device of the reclining chair.

A conventional reclining chair has a very complex adjustment control device to adjust a backrest of the conventional reclining chair. The adjustment control device often has a torsion spring. However, an elastic fatigue of the torsion spring occurs easily after a long period of usage.

SUMMARY OF THE INVENTION

An object of the present invention is to provide a reclining chair which is operated manually and easily to adjust an angle of a backrest.

Another object of the present invention is to provide a reclining chair which has a positioning pin inserted through an inner threaded socket of a tube and one of the positioning holes of a rod in order to fasten the tube and the rod stably.

Another object of the present invention is to provide a reclining chair which has a control device to adjust an angle of a backrest manually and stably.

Accordingly, a reclining chair comprises a backrest, a seat connected to the backrest, a pair of armrests connected to the backrest, a support frame connected to the armrests, a control switch disposed on one of the armrests, and a control device. The control device has a tube connected to the support frame, a joint disposed on a bottom of the seat, a rod inserted through the tube, an end of the rod connected to the joint, a cylindrical block, a control thread connected to the control switch and the cylindrical block, a connector, a positioning mount, a hollow cylinder disposed on the positioning mount, a compression spring, a positioning pin, and an inner threaded socket disposed on the tube to communicate with the tube. The rod has a plurality of positioning holes. The positioning mount has an angle plate having a slot and a through aperture communicating with the slot. The hollow cylinder has a through hole and an outer thread. The positioning pin has a head, an enlarged neck, and a tail having a round hole. The compression spring is inserted in the hollow cylinder. The positioning pin passes through the compression spring and the hollow cylinder. The enlarged neck of the positioning pin blocks the compression spring. The connector has a pair of circular holes and a pair of circular apertures. The outer thread of the hollow cylinder engages with the inner threaded socket. The connector clamps the tail of the positioning pin. The control thread passes through the through aperture of the angle plate of the positioning mount. Th cylindrical block is inserted in the connector. The head of the positioning pin is inserted through the inner threaded socket and inserted in one of the positioning holes of the rod.

DETAILED DESCRIPTION OF THE INVENTION

Figure 1:
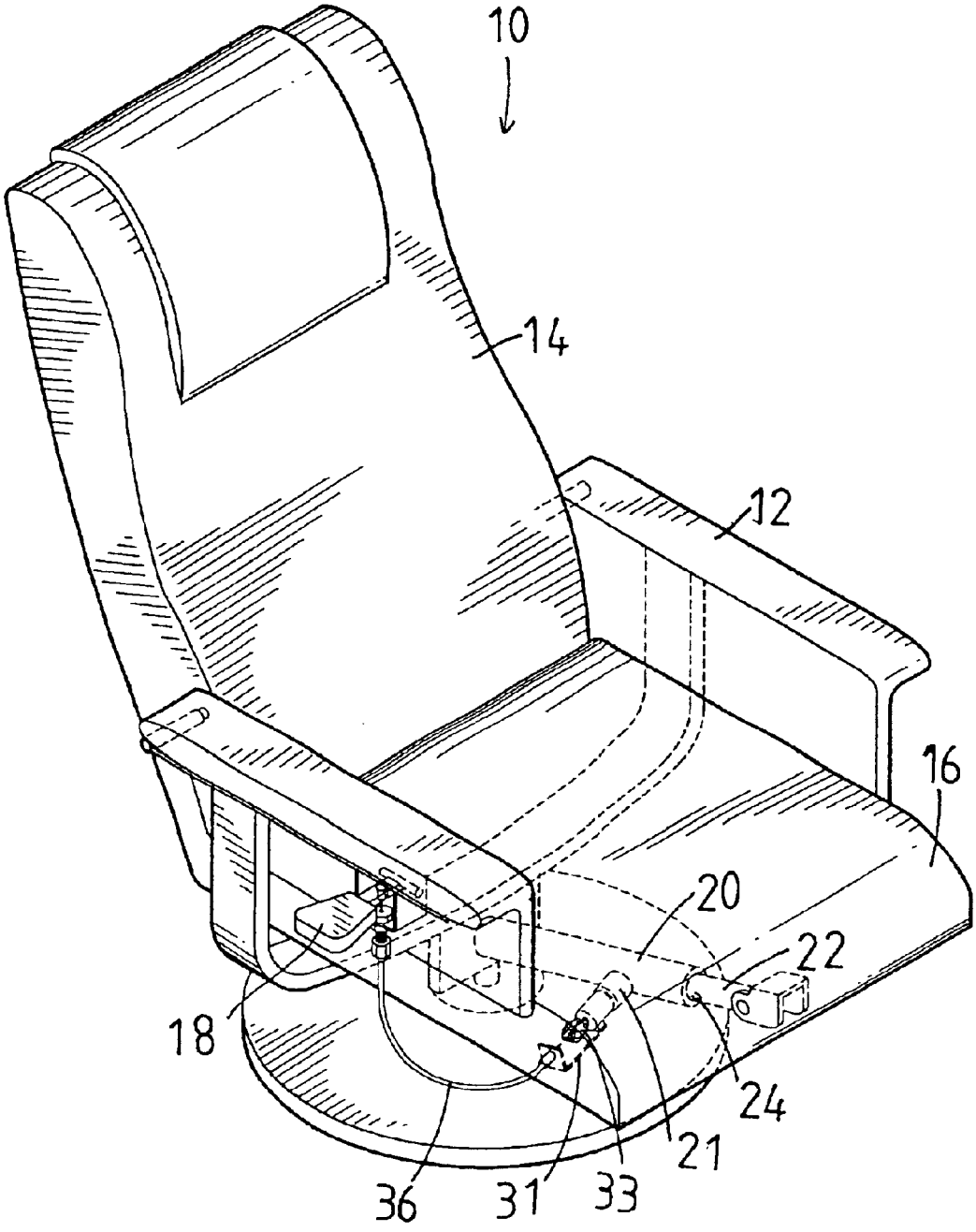
FIG. 1 is a perspective view of a reclining chair of a preferred embodiment in accordance with the present invention.
Figure 2:
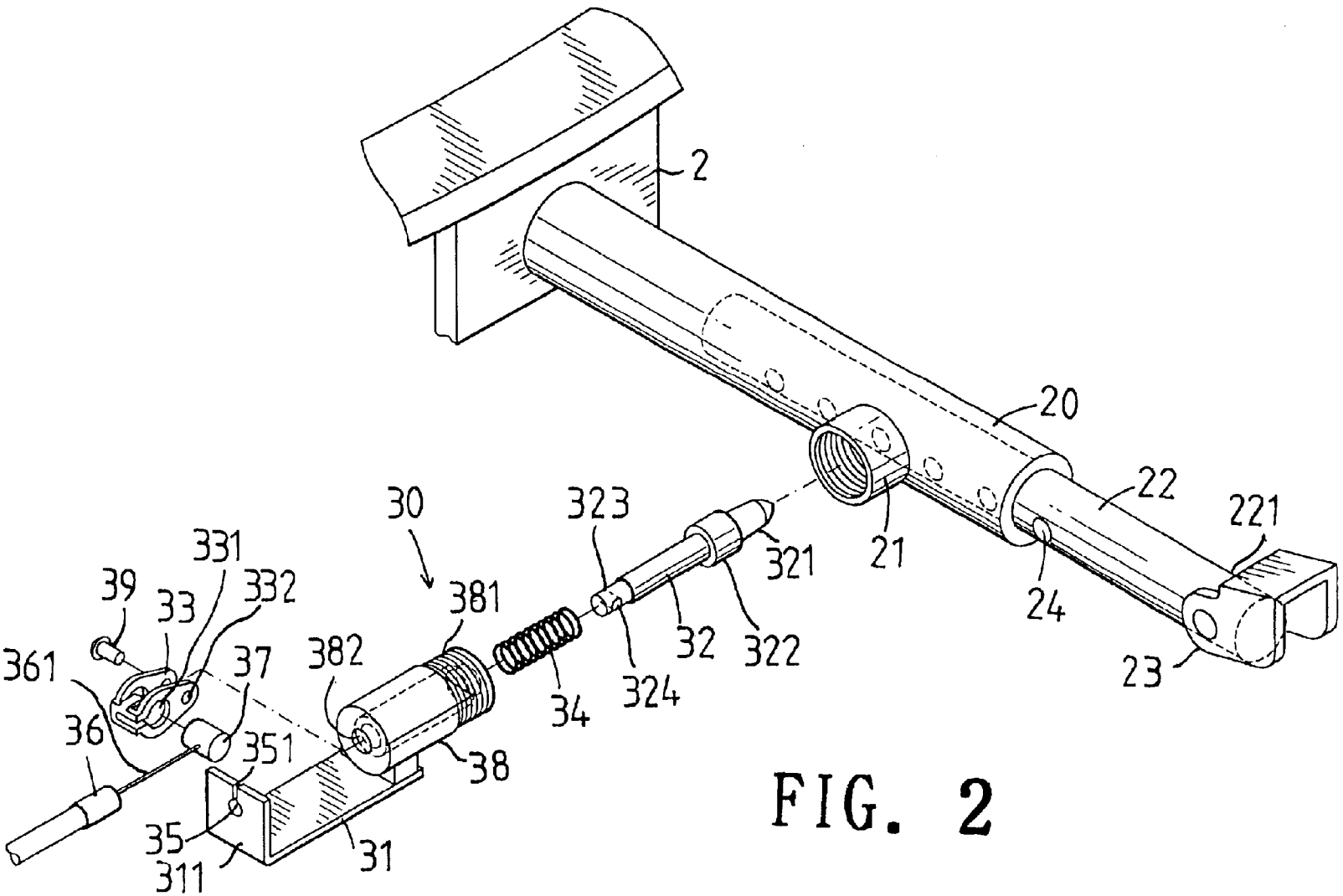
FIG. 2 is a perspective exploded view of a control device of a preferred embodiment in accordance with the present invention.
Figure 3:
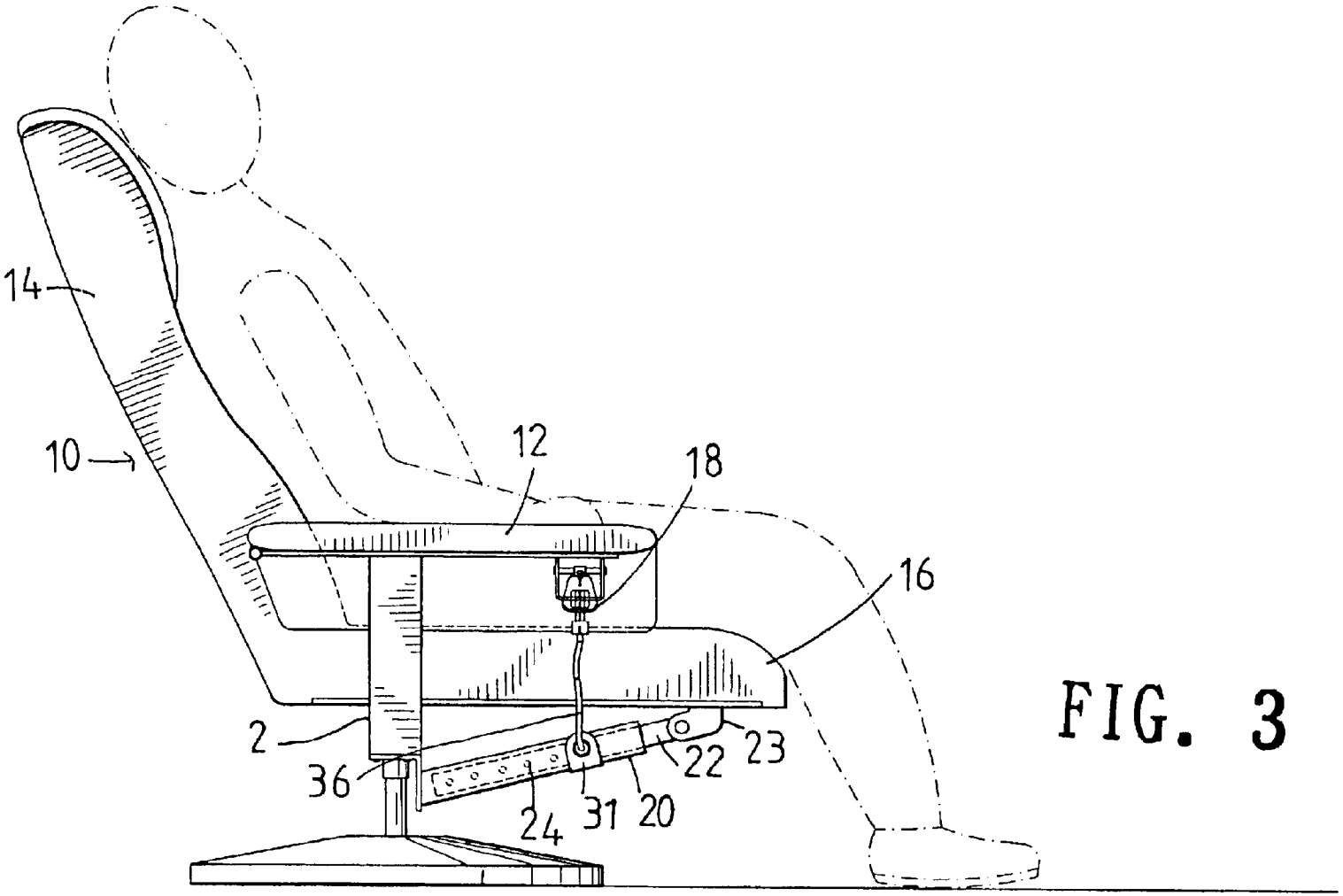
FIG. 3 is a schematic view illustrating a first operation of a reclining chair of a preferred embodiment in accordance with the present invention.

Referring to FIGS. 1 to 3, a reclining chair 10 comprises a backrest 14, a seat 16 connected to the backrest 14, a pair of armrests 12 connected to the backrest 14, a support frame 2 connected to the armrests 12, a control switch 18 disposed on one of the armrests 12, and a control device 30.

The control device 30 has a tube 20 connected to the support frame 2, a joint 23 disposed on a bottom of the seat 16, a rod 22 inserted through the tube 20, an end 221 of the rod 22 connected to the joint 23, a cylindrical block 37, a control thread 361 connected to the control switch 18 and the cylindrical block 37, a sheath 36 enclosing a portion of the control thread 361, a connector 33, a rivet 39, a positioning mount 31, a hollow cylinder 38 disposed on the positioning mount 31, a compression spring 34, a positioning pin 32, and an inner threaded socket 21 disposed on the tube 20 to communicate with the tube 20.

The rod 22 has a plurality of positioning holes 24.

The positioning mount 31 has an angle plate 311 having a slot 351 and a through aperture 35 communicating with the slot 351.

The hollow cylinder 38 has a through hole 382 and an outer thread 381.

The positioning pin 32 has a head 321, an enlarged neck 322, and a tail 323 having a round hole 324.

The compression spring 34 is inserted in the hollow cylinder 38.

The positioning pin 32 passes through the compression spring 34 and the hollow cylinder 38. The enlarged neck 322 of the positioning pin 32 blocks the compression spring 34.

The connector 33 has a pair of circular holes 331 and a pair of circular apertures 332.

The outer thread 381 of the hollow cylinder 38 engages with the inner threaded socket 21.

The connector 33 clamps the tail 323 of the positioning pin 32.

The connector 33 has a pair of circular holes 331 to receive the cylindrical block 37, and a pair of circular apertures 332.

The control thread 361 passes through the through aperture 35 of the angle plate 311 of the positioning mount 31.

The cylindrical block 37 is inserted in the connector 33.

The rivet 39 passes through the circular apertures 332 of the connector 33 and the round hole 324 of the tail 323 of the positioning pin 32 to fasten the connector 33 and the positioning pin 32.

Figure 6:
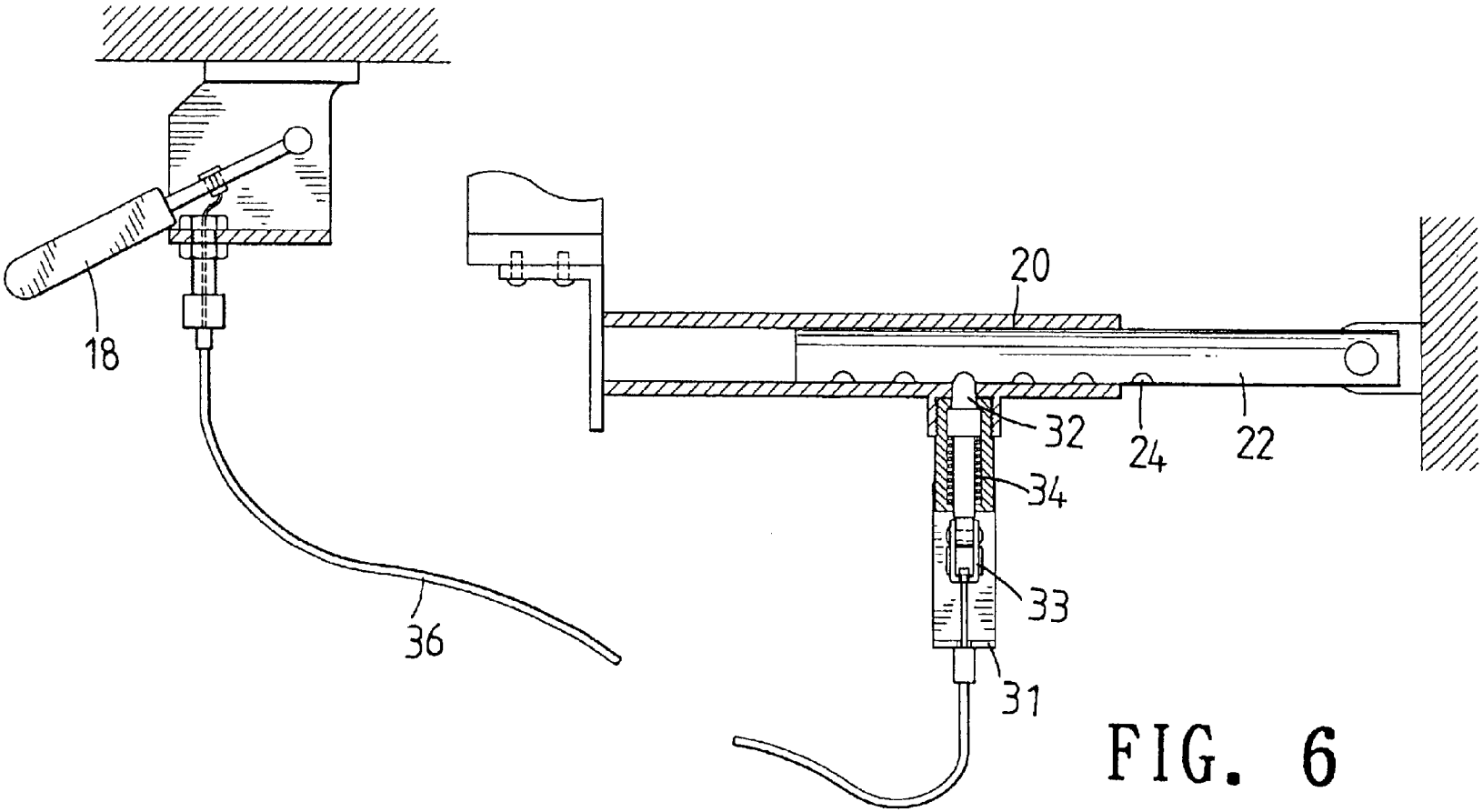
FIG. 6 is a schematic view illustrating a fourth operation of a reclining chair of a preferred embodiment in accordance with the present invention.

Referring to FIG. 6, the head 321 of th positioning pin 32 is inserted through the inner threaded socket 21 and inserted in one of the positioning holes 24 of the rod 22.

Figure 4:
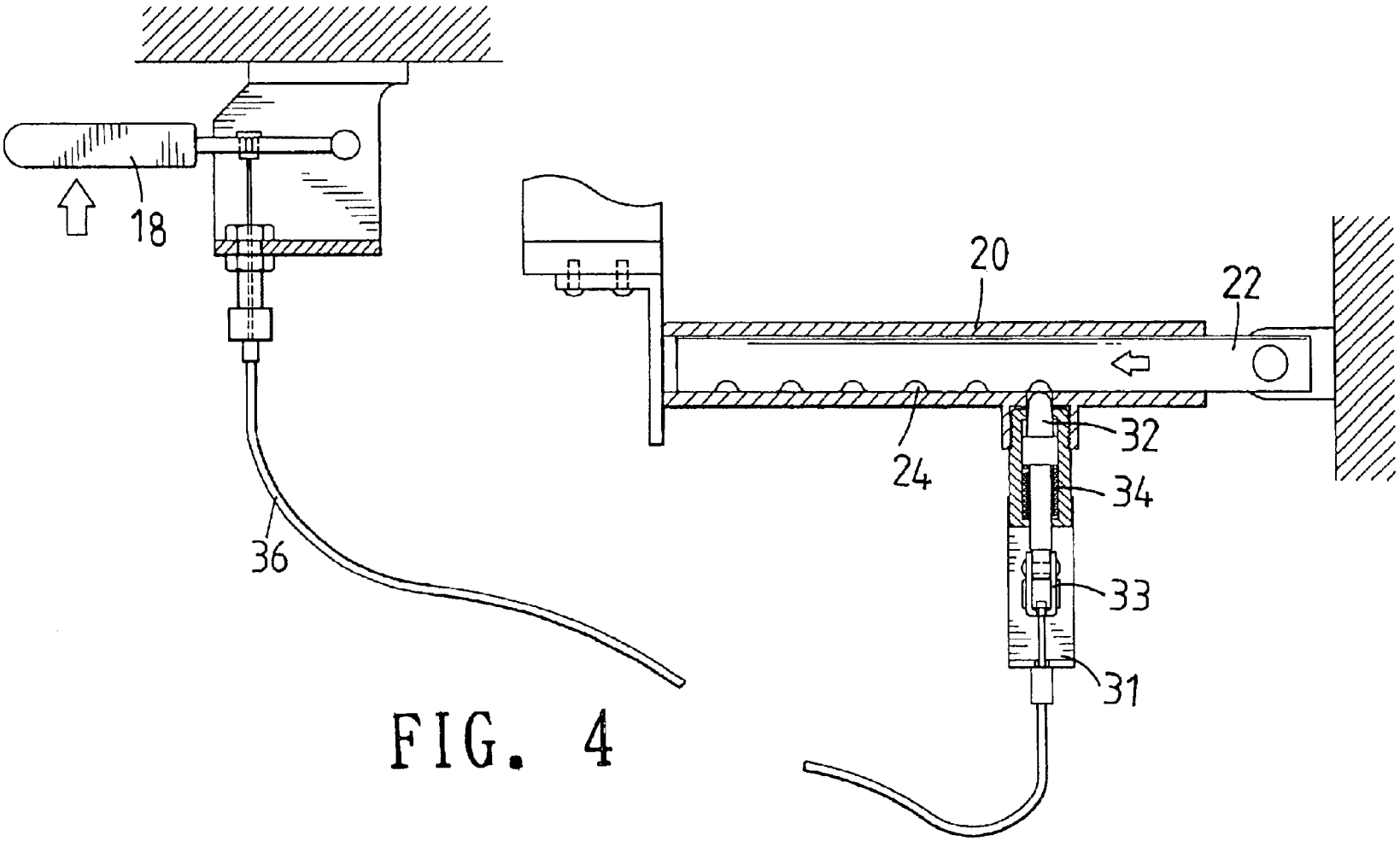
FIG. 4 is a schematic view illustrating a second operation of a reclining chair of a preferred embodiment in accordance with the present invention.
Figure 5:
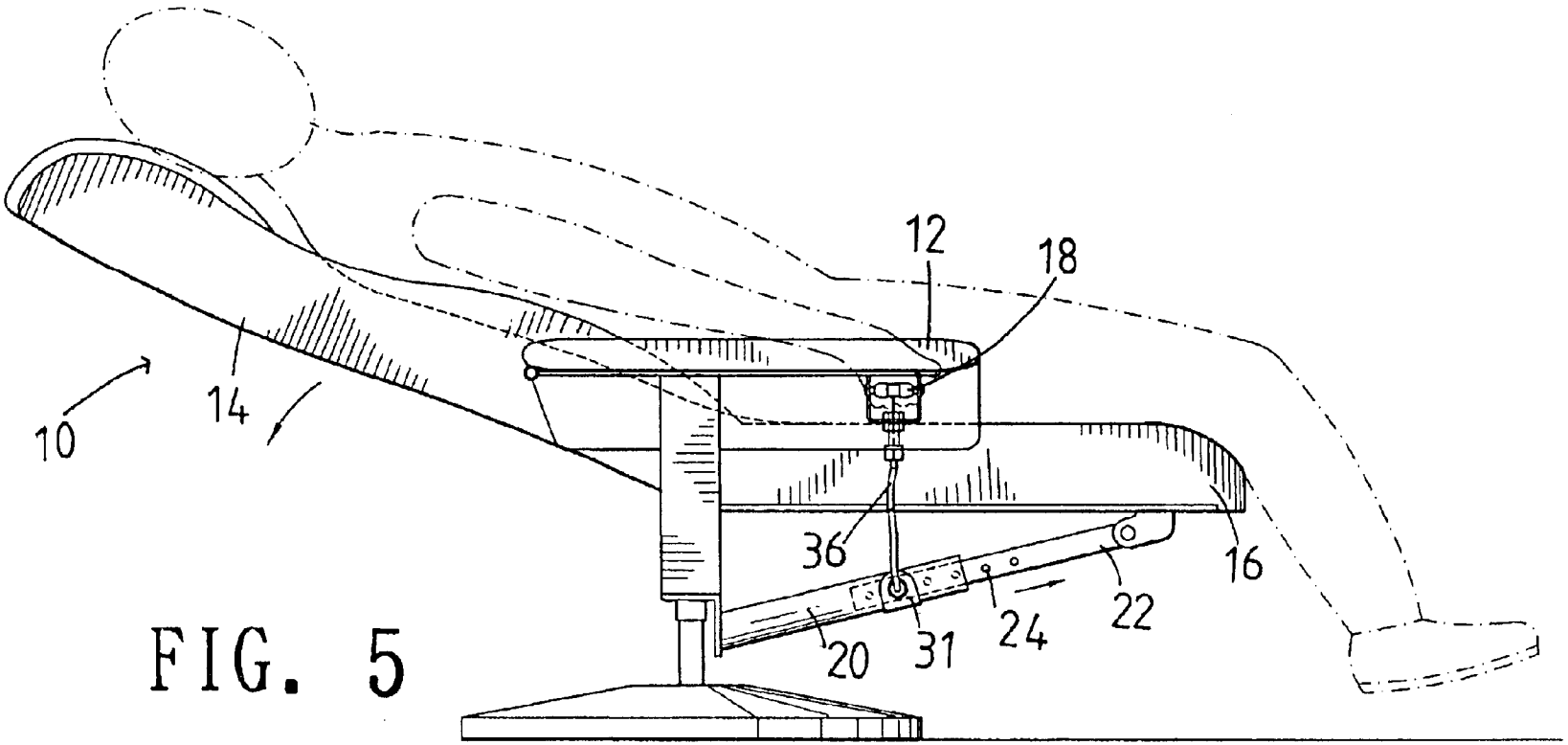
FIG. 5 is a schematic view illustrating a third operation of a reclining chair of a preferred embodiment in accordance with the present invention.

Referring to FIGS. 4 and 5, the control switch 18 is moved upward. The positioning pin 32 disengages from one of the positioning holes 24 of the rod 22. Then a user forces the backrest 14 to decline downward (as shown in FIG. 5).

Referring to FIG. 6 again, the control switch 18 is moved downward later. The compression spring 34 forces the positioning pin 32 to be inserted in the other of the positioning holes 24 of the rod 22.

The present invention is not limited to the above embodiment but various modification thereof may be made. Furthermore, various changes in form and detail may be made without departing from the scope of the present invention.

I claim:

1. A reclining chair comprises:

a backrest, a seat connected to the backrest, a pair of armrests connected to the backrest, a support frame connected to the armrests, a control switch disposed on one of the armrests, and a control device, the control device having a tube connected to the support frame, a joint disposed on a bottom of the seat, a rod inserted through the tube, an end of the rod connected to the joint, a cylindrical block, a control thread connected to the control switch and the cylindrical block, a connector, a positioning mount, a hollow cylinder disposed on the positioning mount, a compression spring, a positioning pin, and an inner threaded socket disposed on the tube to communicate with the tube, the rod having a plurality of positioning holes, the positioning mount having an angle plate having a slot and a through aperture communicating with the slot, the hollow cylinder having a through hole and an outer thread, the positioning pin having a head, an enlarged neck, and a tail having a round hole, the compression spring inserted in the hollow cylinder, the positioning pin passing through the compression spring and the hollow cylinder, the enlarged neck of the positioning pin blocking the compression spring, the connector having a pair of circular holes and a pair of circular apertures, the outer thread of the hollow cylinder engaging with the inner threaded socket, the connector clamping the tail of the positioning pin, the control thread passing through the through aperture of the angle plate of the positioning mount, the cylindrical block inserted in the connector, the head of the positioning pin inserted through the inner threaded socket and inserted in one of the positioning holes of the rod, wherein the control switch is moved upward, the positioning pin disengages from one of the positioning holes of the rod and the backrest is forced to decline downward, and wherein the control switch is moved downward later, and the compression spring forces the positioning pin to be inserted in the other of the positioning holes of the rod.

2. The reclining chair as claimed in claim 1, wherein a sheath encloses a portion of the control thread.

3. The reclining chair as claimed in claim 1, wherein the connector has a pair of circular holes to receive the cylindrical block, and a pair of circular apertures.

4. The reclining chair as claimed in claim 3, wherein a rivet passes through the circular apertures of the connector and the round hole of the tail of the positioning pin to fasten the connector and the positioning pin.

* * * * *